US005499857A

United States Patent [19]

Lynch, Jr.

[11] Patent Number: 5,499,857

[45] Date of Patent: Mar. 19, 1996

[54] FOLDING CHAIR

[76] Inventor: Robert W. Lynch, Jr., 7724 Lake Highland Dr., Fort Worth, Tex. 76179

[21] Appl. No.: 342,123

[22] Filed: Nov. 18, 1994

[51] Int. Cl.[6] ..... A47C 4/38

[52] U.S. Cl. ..... 297/162; 297/45

[58] Field of Search ..... 297/16.1, 16.2, 297/45, 46, 47, 59

[56] References Cited

U.S. PATENT DOCUMENTS

| | | | |
|---|---|---|---|
| 244,216 | 7/1881 | Fenby | 297/45 |
| 291,062 | 1/1884 | LaTour . | |
| 1,035,823 | 8/1912 | Hay . | |
| 1,979,278 | 11/1934 | McMurtry . | |
| 2,473,090 | 6/1949 | Becker . | |
| 2,690,792 | 10/1954 | Moss . | |
| 2,691,410 | 10/1954 | Boucher . | |
| 3,124,387 | 3/1964 | MacLaren | 297/16.2 |
| 3,838,883 | 10/1974 | Machen . | |
| 4,014,591 | 3/1977 | Gittings | 297/55 |
| 4,047,753 | 9/1977 | Uchida . | |
| 4,158,520 | 4/1979 | Miller . | |
| 4,258,951 | 3/1981 | Groom . | |
| 4,359,244 | 11/1982 | Koehm . | |
| 4,605,261 | 8/1986 | Lee | 297/16.2 |
| 4,671,566 | 6/1987 | Knapp et al. . | |
| 4,673,211 | 6/1987 | Hoffman . | |
| 4,807,930 | 2/1989 | Helfrich . | |
| 4,836,601 | 6/1989 | Cone . | |
| 5,054,849 | 10/1991 | Hoff . | |
| 5,332,283 | 7/1994 | Gray . | |

OTHER PUBLICATIONS

MotorHome magazine, Sep. 1994, p. 106, upper right (Reader Service Card No. 211).

The Crate and Barrel 1993 Spring and Summer Catalogue, p. 4, Fig. A (Sand Chair).

Werland Rocking Chairs brochure, undated, var. figures.

Campmor late Spring 1994 catalog, p. 44, var. figures.

*Primary Examiner*—Peter R. Brown

*Attorney, Agent, or Firm*—Guy V. Manning

[57] ABSTRACT

A folding chair comprises a front, scissors-like X-structure formed by two pivotally coupled rigid members, the lower ends of which form front feet and the upper ends of which form front seat corners of the chair. Rearward the scissors structure, an inverted Y-structure includes a pair of downwardly depending rear legs diverging from a central hinge to form rear feet and a stile pivotally coupled to the hinge and extending upwardly opposite the legs. Two spindles link the front feet to an apex coupled to the hinge by a tether, and two lateral braces link the rear feet to the front seat corners, the braces and the spindles being pivotally coupled together where they cross. The stile opposite the hinge includes a transverse rail from which is suspended a hammock seat extending downward to the front seat corners on the scissors structure. The chair folds to a tight bundle for carrying, the hammock seat doubling as a shoulder sling. The chair quickly deploys by spreading the front feet, thereby causing the rear feet to spread apart and to extend rearwardly from the front feet. The stile, folded downwardly between the rear legs for carrying, pivots upwardly at the hinge and latches into place to support the upper end of the hammock.

27 Claims, 10 Drawing Sheets

FIG. 13A
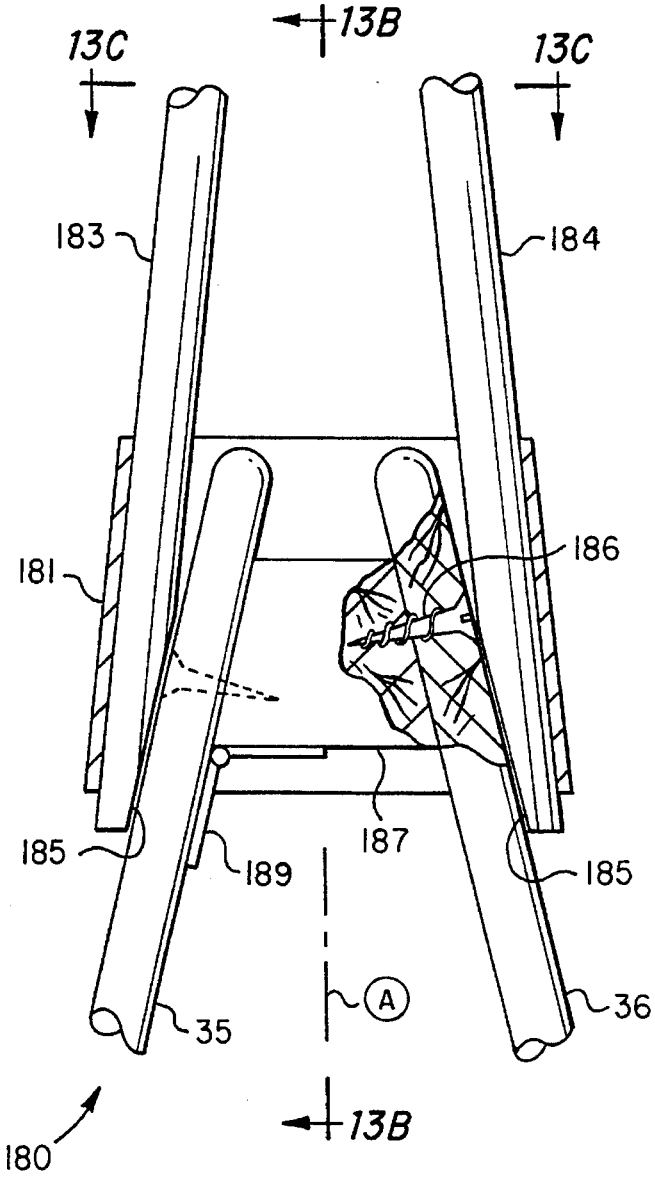
FIG. 13B
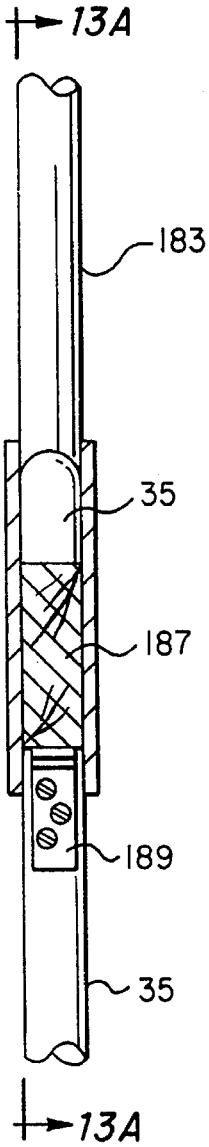
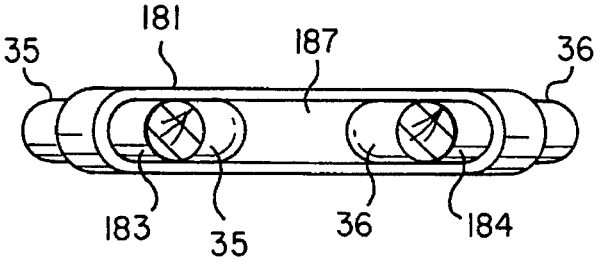
FIG. 13C

FOLDING CHAIR

BACKGROUND OF THE INVENTION

1. Field of the Invention

This invention relates to improvements to folding chairs, and more specifically for folding chairs designed for convenient transportation for leisure or other activities.

2. Description of Related Art

Concert goers, festival attenders and others engaging in leisure activities frequently desire seating in settings remote from localities where traditional furniture is available. Though often simply sitting on the ground or sidewalk on blankets or pillows, some bring along chairs for added comfort. Often, such chairs are foldable and adapted for just such use, but just as often, they are still bulky or inconvenient to carry.

A common example is a chair, stool or lounger constructed from three-quarter inch aluminum tubing supporting laced straps or a solid webbed seat. Such chairs usually collapse in one dimension only, either longitudinally or laterally, but usually not both directions, causing them to remain bulky and inconvenient to carry.

Many folding chairs are available which collapse in to more or less compact bundles, but they often are heavy and not really adapted for carrying substantial distances. For example, Boucher, U.S. Pat. No. 2,691,410, provides what has become known as the "butterfly" chair comprising interconnected steel rods forming feet and seat corners at their apices, the seat corners fitting into pockets of a webbed seat. Because these chairs usually are made of steel for strength, they have substantial weight and are found more often on patios than at outings. Numerous other examples provide varying degrees of compactness and portability, but they usually lack either stability, comfort or strength. A need therefore continues to exist for a compact folding chair which is lightweight, inexpensive and convenient to carry.

SUMMARY OF THE INVENTION

Accordingly, it is an object of this invention to provide a folding chair which collapses to a compact bundle for carrying.

It is another object of this invention to provide a folding chair which is lightweight and convenient for carrying.

It is another object of this invention to provide a folding chair which is inexpensive to manufacture and consequently cost effective for a wide number of recreational activities.

The foregoing and other objects of this invention are achieved by providing a folding chair comprising a front, scissors structure formed by two pivotally coupled rigid members, the lower ends of which form front feet and the upper ends of which form front seat corners of the chair. Rearward of the scissors structure, an inverted Y-structure includes a pair of downwardly depending rear legs diverging from a central hinge to form rear feet and a stile pivotally coupled to the hinge and extending upwardly opposite the legs. Two spindles link the front feet to an apex coupled to the hinge by a tether, and two lateral braces link the rear feet to the front seat corners, the braces and the spindles being pivotally coupled together where they cross. The stile opposite the hinge includes a transverse rail from which is suspended a hammock extending to the front seat corners of the scissors structure to form the seat of the chair. The chair folds to a tight bundle for carrying and the hammock serves as a shoulder strap. The chair quickly deploys by spreading the front feet, thereby causing the rear feet to spread apart and to extend rearwardly from the front feet. The stile, folded downwardly between the rear legs for carrying, pivots upwardly at the hinge and latches into place to support the upper end of the hammock and to form the back of the chair seat.

BRIEF DESCRIPTION OF THE DRAWINGS

The novel features believed characteristic of the present invention are set forth in the appended claims. The invention itself, however, as well as a preferred mode of use and further objects and advantages thereof, best will be understood by reference to the following detailed description of an illustrative embodiment when read in conjunction with the accompanying drawings, wherein:

FIGS. 13A–13C detail a second alternate hinge means employed in the chair back of FIG. 12.

DETAILED DESCRIPTION OF A PREFERRED EMBODIMENT

Figure 1B:
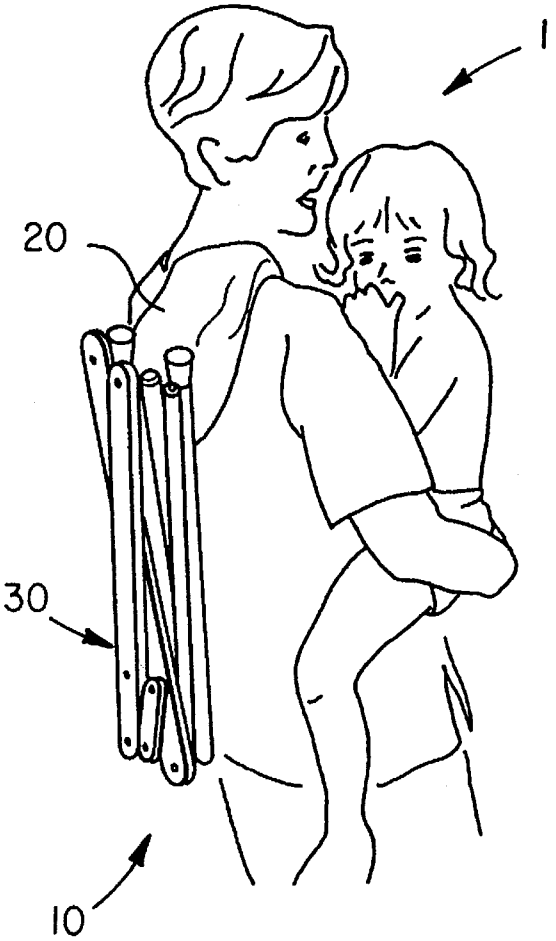
FIGS. 1A and 1B depict the folding chair of the present invention in use, deployed for sedating and folded for transportation, respectively.
Figure 1A:
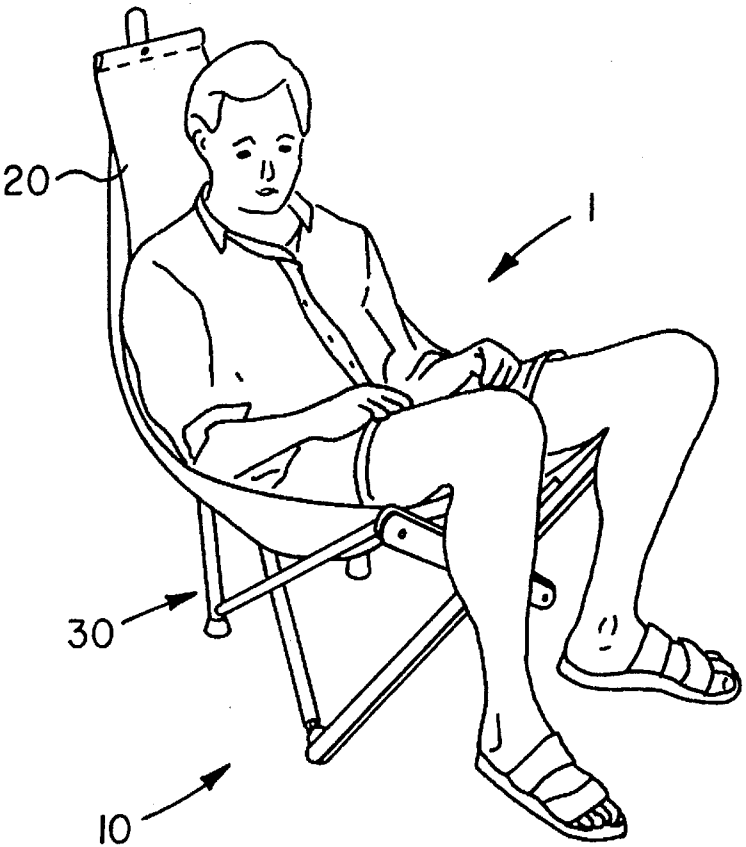

With reference now to the figures, and in particular to FIGS. 1A and 1B, chair 10 is shown deployed with user 1 seated therein, and folded and slung across the shoulder of another user 1. Chair 10 comprises web seat 20, made of cloth or other suitable flexible material, which forms the seating surface of chair 10 while doubling as a sling for convenient carrying (FIG. 1B). Frame 30 comprises rigid members hingedly and pivotally coupled in fashion described below such that chair 10 may be quickly deployed or folded for transporting. NOTE: for convenience hereinafter, opposing ends of selected members will be labeled "A" and "B" to signify their upper and lower ends, respectively; also, where convenient, members successively numbered first odd and then even will represent like members on opposite sides of chair 10.

Figure 2:
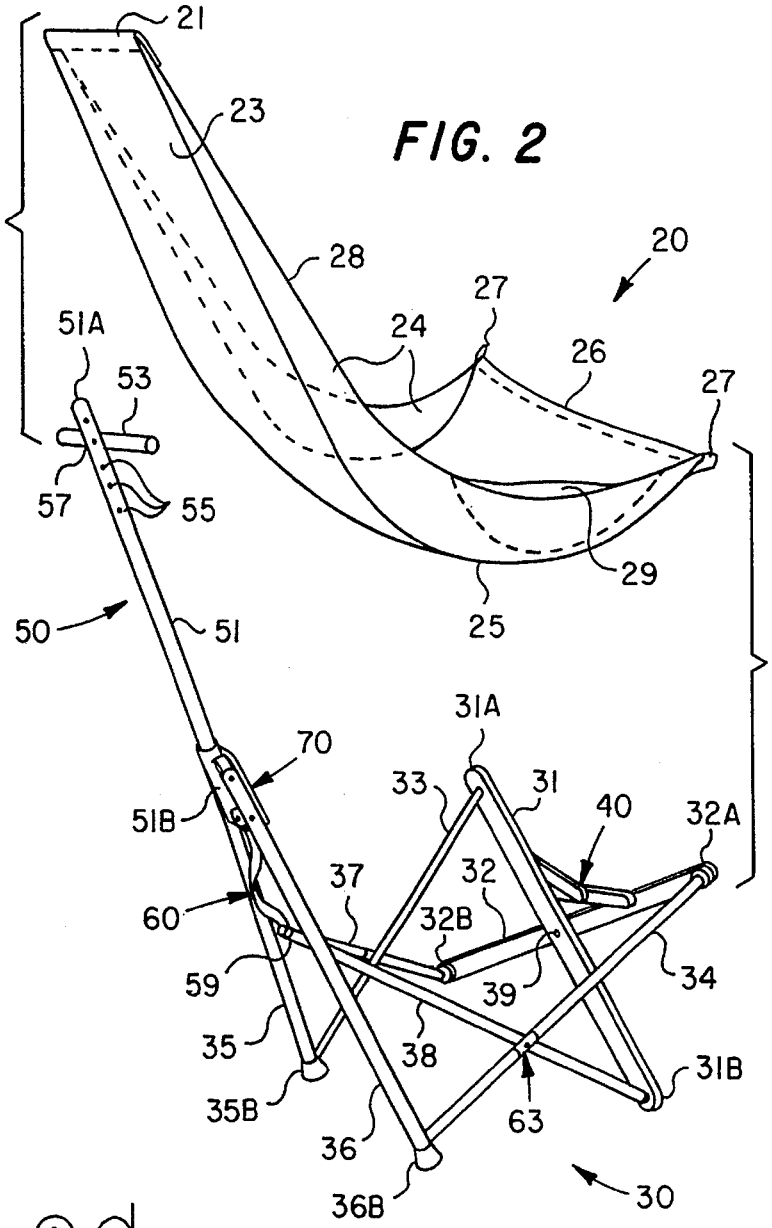
FIG. 2 Shows a preferred embodiment of the folding chair in rear, quartering perspective, with the frame and the webbed seat exploded vertically.

FIG. 2 depicts the preferred embodiment of chair 10. Seat 20, depicted vertically separated from frame 30 for clarity, comprises sling 23 spanning between the upper end of frame 30 to front seat corners 31A, 32A described in more detail below. Sling 23 has a shape substantially that of a regular trapezoid having a small base at the top which includes a sheath 21 adapted to surround rail 53 coupled to the upper rear portion 50 of frame 30. Strap 26 stitched into the lower base of trapezoidal sling 23 spans between and couples to front seat corners 31A, 32A by convenient means. Panels 24 provide sidewalls for seat 20. Panels 24 have one arcuate edge mating with a side of sling 23, and a shorter, opposing edge 28 substantially forming a chord for the arc formed by the arcuate edge. Because the upper edge 28 is a chord, it necessarily is shorter than the arcuate edge of panel 24 which mates with the side of sling 23. Thus, when suspended between rail 53 and front seat corners 31A, 32A, upper edge 28 of panel 24 lifts panel 24 into a plane extending vertically from sling 23.

Pocket means 29 may be included into panels 24. Pocket means 29 may be a pouch stitched to the side of panel 24 (not shown), or it may be a second panel partially or entirely coextensive with panel 24 and stitched to panel 24 along substantially all of its perimeter except for an opening along upper edge 28 conveniently located between sheath 21 and strap corner 27 and facing upwardly for access to the interior of the pocket. One having ordinary skill in the art will recognize that other pocket means configurations could be integrated with panels 24 without departing from the spirit and scope of the present invention.

Figure 3A:
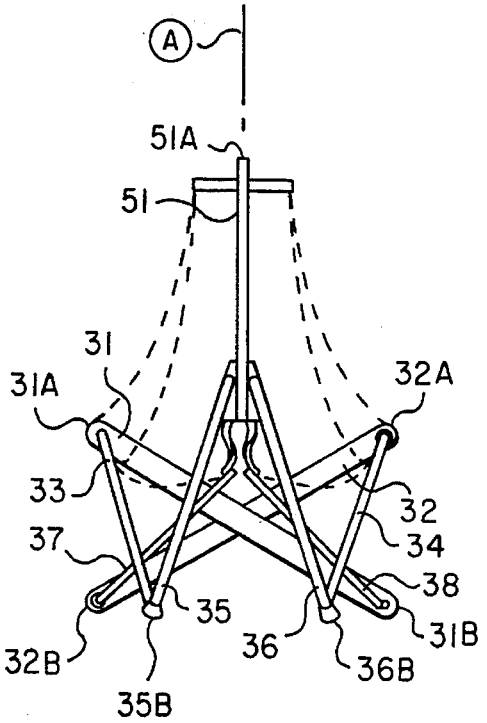
FIGS. 3A and 3B are views of the chair frame of FIG. 2 from the rear and from the side, respectively.
Figure 3B:
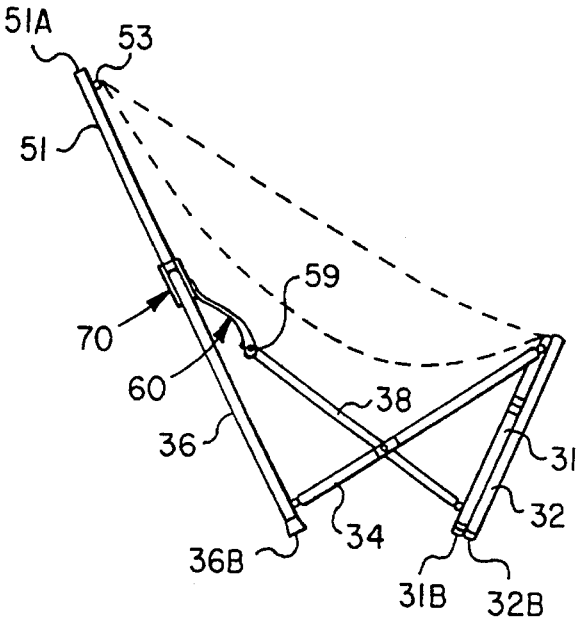

FIGS. 2, 3A and 3B, further detail frame 30 comprising three simple structures, a front X-structure and a rear, inverted Y-structure, linked together by an inclined V-structure, each structure disposed transverse longitudinal axis A of chair 10. Rigid members 31, 32 are pivotally coupled at approximately their midpoints 39 to form the X-structure. Upper ends 31A, 32A of members 31, 32 form front seat corners of seat 20, and lower ends 31B, 32B form the front legs and feet of chair 10.

Figure 6A:
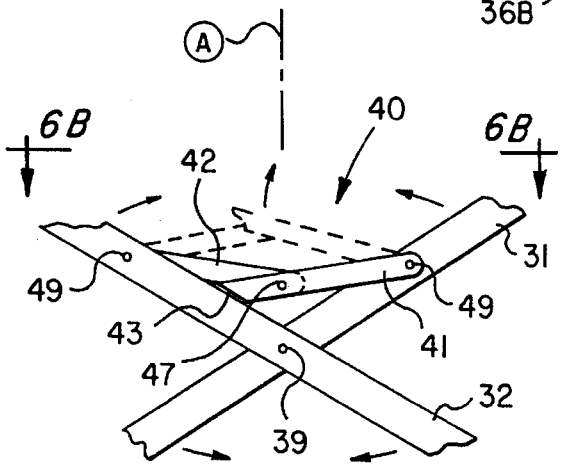
FIG. 6A and 6B detail an extension brace locking the front legs when the chair is deployed.
Figure 6B:
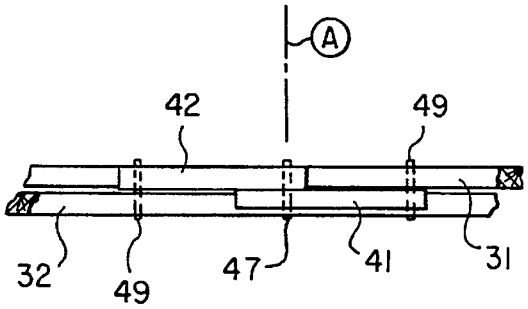

As detailed in FIGS. 6A and 6B, extension brace 40 spans between members 31, 32 to lock the X-structure into deployed position. Brace arms 41, 42 each pivot at points 49 from members 31, 32 respectively, and are pivotally coupled at point 47 above midpoint 39 of members 31, 32. Brace 40 thus limits the extension of the X-structure to the degree to which brace arms 41, 42 would become aligned. The width of seat 20 is selected, however, such that upper ends 31A, 32A are restrained from further separation before such degree of extension of the X-structure occurs. Such restraint provides a positive resistance to full alignment of brace arms 41, 42, thereby creating a break-over effect when they are forced into alignment by downward or upward pressure at pivot point 47. Resiliency of seat 20 permits such break-over and forces beveled edge 43 of brace arm 41 against the upper edge of member 32, thereby creating a locked, stable X-structure. Force upward on pivot point 47 sufficient to overcome the resiliency of seat 20 unlocks the X-structure for folding.

Figure 7C:
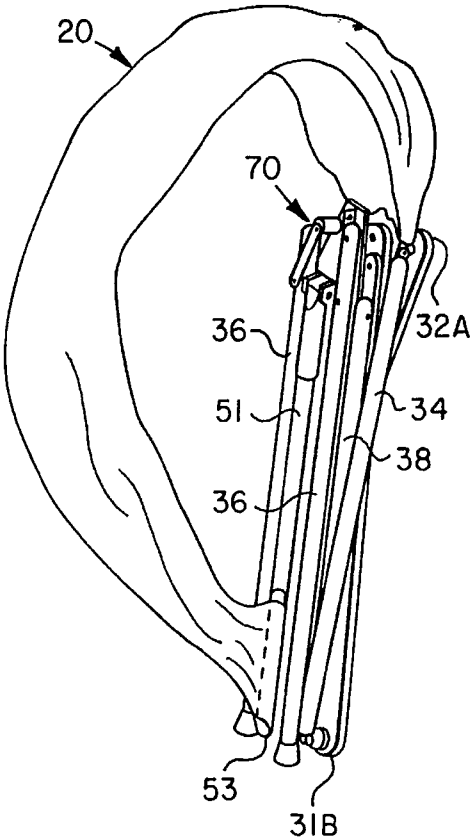
FIG. 7A–7C depict successive stages of the chair as it is converted from its deployed to its bundled configuration, or vice versa.
Figure 7B:
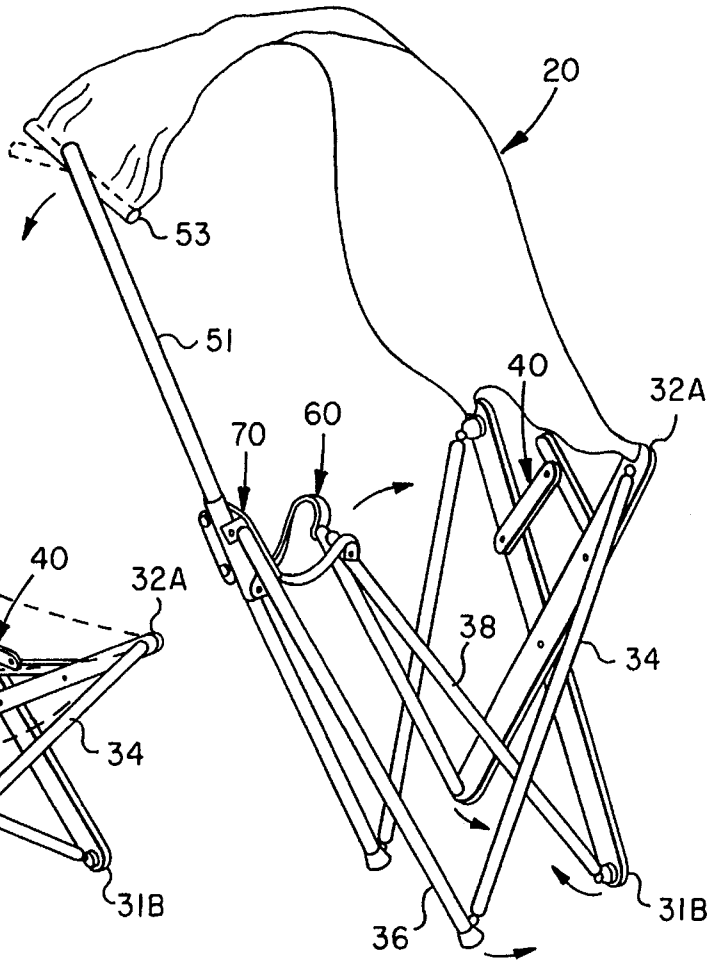
Figure 7A:
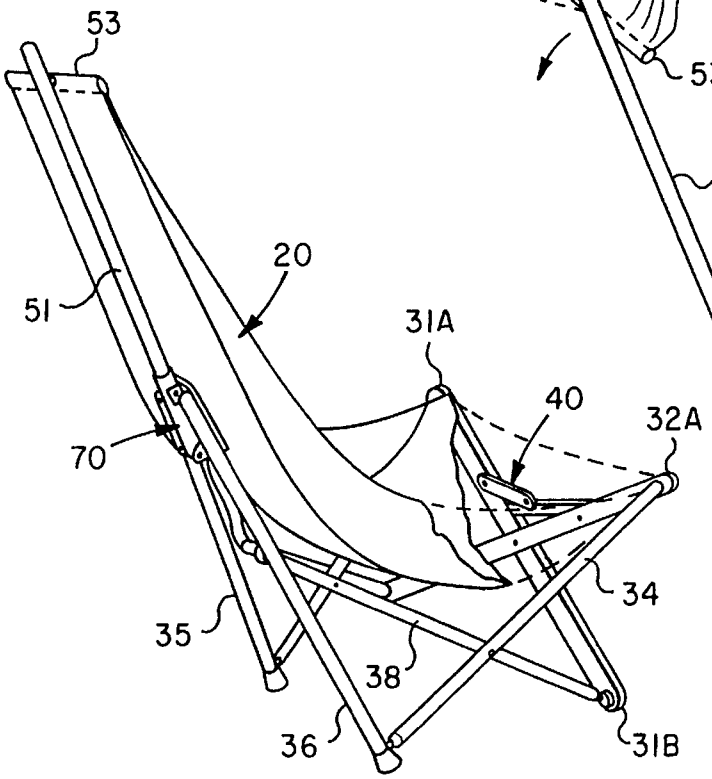

Disposed rearwardly along axis A, back means 50 for chair 10 comprises an inverted Y-structure having downwardly extending rear legs 35, 36 and upwardly extending stile 51. Rear legs 35, 36 couple to hinge means 70 at their upper ends 35A, 36A and diverge downwardly to feet 35B, 36B. End 51B of stile 51 couples to hinge means 70 and extends coplanar with and opposite legs 35, 36 to support the upper extreme of seat 20. Transverse rail 53 is pivotally pinned by rail pin 57 to one of several vertical positions 55 along the upper end 51A of stile 51. Rail 53 cooperates with sheath 21 in seat 20 to support seat 20 at its upper end. As depicted in FIGS. 7B, 7C, rail 53 pivots to align with stile 51 when chair 10 is folded for carrying.

Figure 5B:
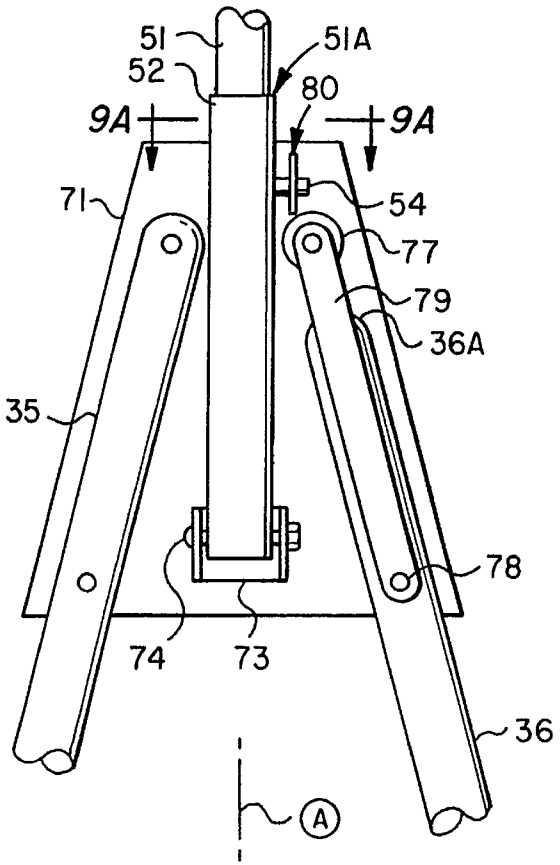
FIGS. 5A and 5B detail one side of the hinge means of FIG. 4 from the rear of the chair, depicting positions thereof when the chair is folded and deployed, respectively.
Figure 5A:
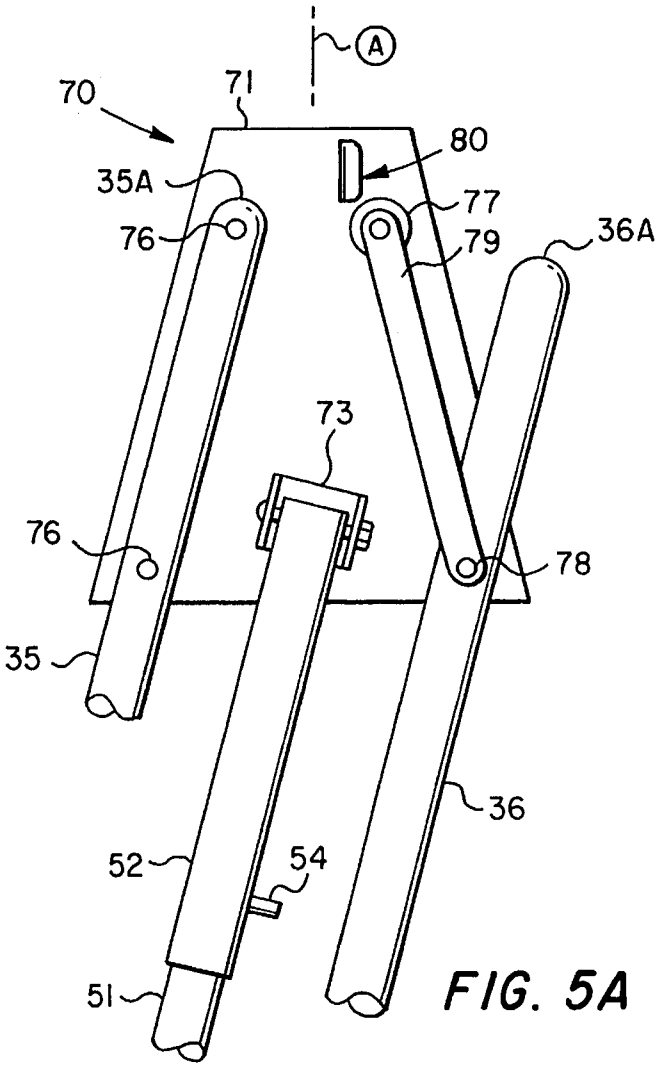

As depicted in FIGS. 5A and 5B, hinge means 70 comprises a unique system for aligning legs 35, 36 and stile 51 when chair 10 is folded, and for creating a rigid junction defining the inverted Y-structure in the preferred embodiment of chair 10. Leg 35 is rigidly pinned to gusset plate 71 at two points 76. Leg 36, is pivotally pinned at the lower end of plate 71 at pivot point 78. Beyond leg end 36A, spacer 77 is affixed to plate 71 in a position aligned with leg 36 when chair 10 is fully deployed (FIG. 5B). Spine 79 spans between spacer 77 and pivot point 78 to provide rigidity to the junction of leg 36 and plate 71 when chair 10 is deployed and experiencing loading stresses. When chair 10 is folded for carrying, leg end 36A swings out from beneath spine 79 and leg 36 pivots into parallel disposition adjacent leg 35.

Hinge means 70 also includes clevis 73 and pin 74 pinning barrel 52 to the lower end of gusset plate 71. Barrel 52 receives lower end 51A of stile 51 to strengthen the junction against cantilever loads potentially applied to rail 53 due to loading. Projecting laterally from the side of barrel 52 is peg 54 which cooperates with latch means 80 to secure stile 51 in its deployed position aligned with longitudinal axis A (FIG. 5B). Clevis 73 permits stile 51 to rotate parallel to longitudinal axis A and simultaneously to swivel in a plane parallel to gusset plate 71 during folding, whereby stile 51 lies disposed between legs 35, 36 when chair 10 is folded (FIGS. 5A, 7C).

Figure 9A:
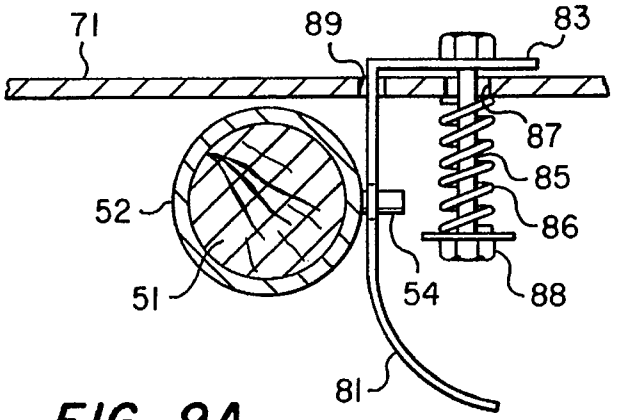
FIGS. 9A and 9B detail a latch means employed as part of the hinge means of FIG. 4.
Figure 9B:
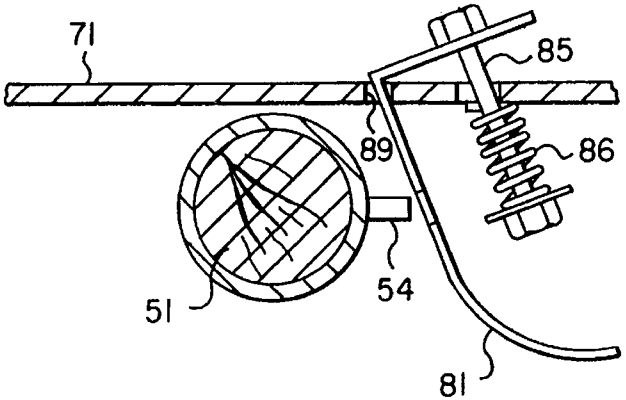

FIGS. 9A and 9B detail in plan view operation and structure of latch means 80. In FIG. 9A, thumb lever 81, disposed substantially normal to gusset plate 71, extends through slot 89 to the front side of plate 71. Lateral base 83 is rigidly coupled to thumb lever 81 and disposed parallel to plate 71. Spring post 85 projects forward from base 83 through elongated hole 87 to the rear side of plate 71. Coiled spring 86 surrounding post 85 bears against plate 71 and nut 88 to urge thumb lever 81 against barrel 52 and cooperates with peg 54 to prevent stile 51 from pivoting about pin 74 of clevis 73. As shown in FIG. 9B, lateral pressure on thumb lever 81 away from barrel 52 causes latch means 80 to rotate and to depress spring 86, freeing peg 54 and permitting stile 51 to rotate away from plate 71. Thumb lever 81 curves away from barrel 52 at its end distal from plate 71. Rotating stile 51 toward plate 71 causes peg 54 to contact the curved portion of thumb lever 81 and to force it away from barrel 52, thereby opening latch means 80 until peg 54 snaps into and is captured by the aperture in thumb lever 81, thereby latching stile 51 into its deployed position.

Figure 15:
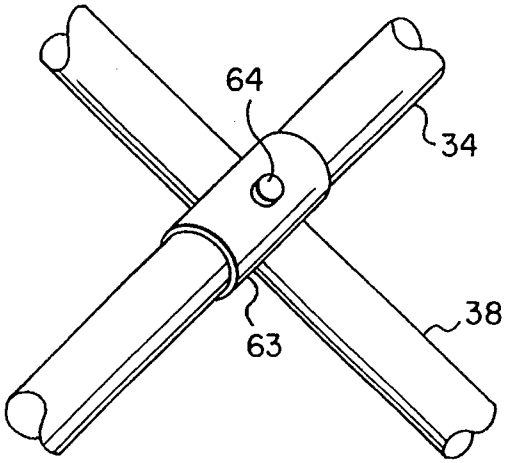
FIG. 15 details a reinforcement collar for a lateral brace.

Returning again now to FIGS. 2, 3A and 3B, spindles 37, 38 extend rearwardly and upwardly from feet 31B, 32B and converge to hinged apex 59, thus forming the V-structure. Lateral braces 33, 34 extend downwardly and rearwardly from seat corners 31A, 31B to rear feet 35B, 36B. Braces 33, 34 pivotally couple to spindles 37, 38, respectively, and collar means 63, detailed in FIG. 15, surrounds lateral braces 33, 34 where they cross. Collar 63 significantly strengthens braces 33, 34 where moment loading due to user 1 moving about in chair 10 can overstress them. Collars 63 preferably are aluminum tubing, at least one (1") inch long and having a fifty thousandths (0.050") inch wall thickness, snugly fitting the diameter of braces 33, 34.

Figure 4:
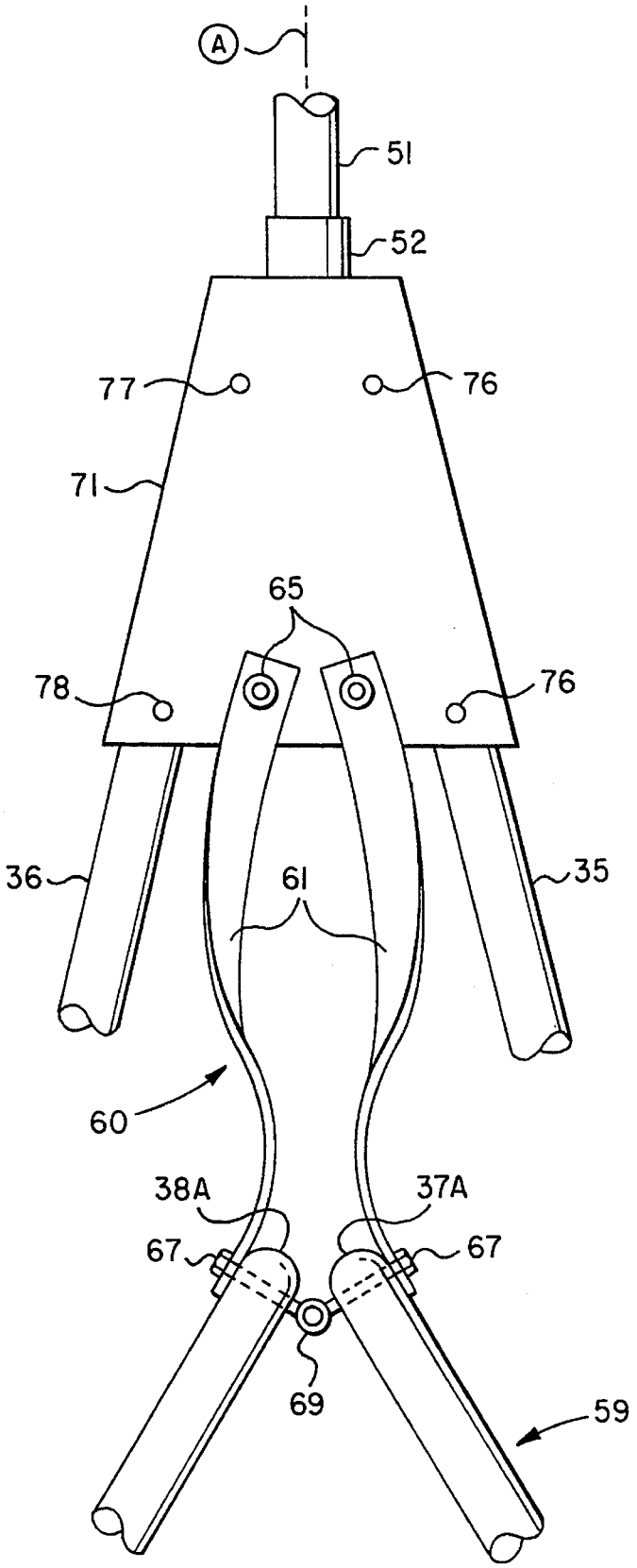
FIG. 4 derails a tether and preferred hinge means embodiment coupling two components of the frame.

Tether means 60 may couple apex 59 to plate 71 of hinge means 70. As detailed in FIG. 4, tether means 60 comprises one or more straps 61 connected between anchors 65 on plate 71 and bolts 67 in spindle ends 37A, 38A. Straps 61 preferably are made of resilient materials such as rubber, elastic or the like, but may be of non-resilient materials or may be absent altogether (see, e.g. FIG. 12). When present, tether means 60 limits travel of hinge means 70 just enough to prevent it from hitting user 1 in the back of the head when he sits down in chair 10. When straps 61 are made of resilient material, tether means 60 becomes cushion means for seat 20. Resilient tether means 60 adds a cushioning effect that not only softens an otherwise sudden jerk when tether means 60 limits forward travel of back means 50, but also significantly cushions and increases the sitting comfort of seat 20.

Figure 8A:
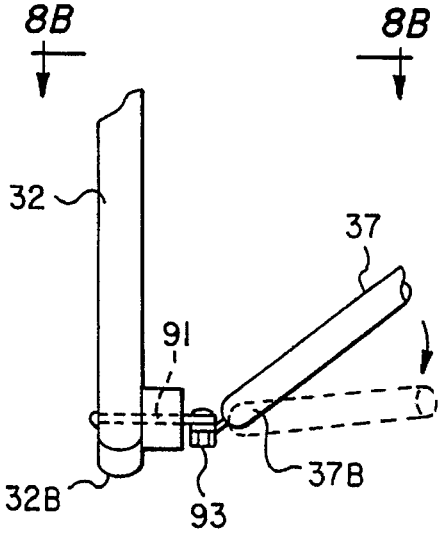
FIGS. 8A and 8B detail a three-dimensional swivel coupling useable between rigid elements of the chair.
Figure 8B:
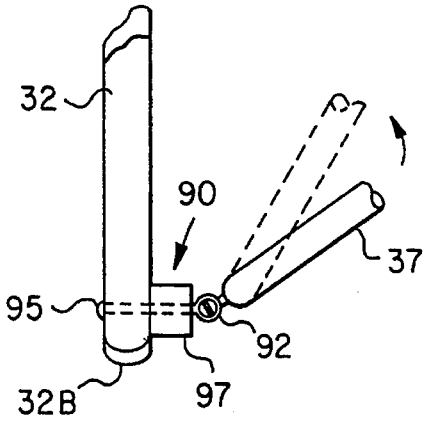

As depicted in FIGS. 8A and 8B, lower spindle ends 37B, 38B couple to front feet 31B, 32B through swivel connections which allow three,-dimensional movement of spindles 37, 38 relative to members 31, 32. Similar three dimensional swivel connections are employed on each end of braces 33, 34 where they couple to rear feet 35B, 36B and to front seat corners 31A, 32A. The swivel connections are depicted in the figures as simple bolts or rivets 93 connecting eye screw 92 to eye bolt 91 which is free to turn, thus producing three-dimensional movement. One having ordinary skill in the art will recognize that other mechanisms such as ball joints could be employed without departing from the spirit and scope of the present invention.

Offset spacer 97 depicted in FIGS. 8A, 8B is required to compensate for the thickness of rigid member 31 where lateral brace 34 couples to front seat corner 32A and where spindle 37 couples to front foot 32B. This is due to the need to keep spindles 37, 38 of equal in length for smooth folding of chair 10. One having ordinary skill in the art will recognize that other modes of accomplishing such symmetry are within the spirit and scope of the present invention. For example, the front X-structure could be constructed of a Latour joint (see U.S. Pat. No. 291,062 issued January 1, 1884), whereby one of the members is bifurcated and held together by plates, and the other member pivots between the halves. Such a joint allows both members to occupy the same plane, and the interior ends of the bifurcated member limit extension of the X-structure when the other member bears against them. In such case, extension brace 40 and offset spacer 97 (FIGS. 8A, 8B) are not required.

Figure 10:
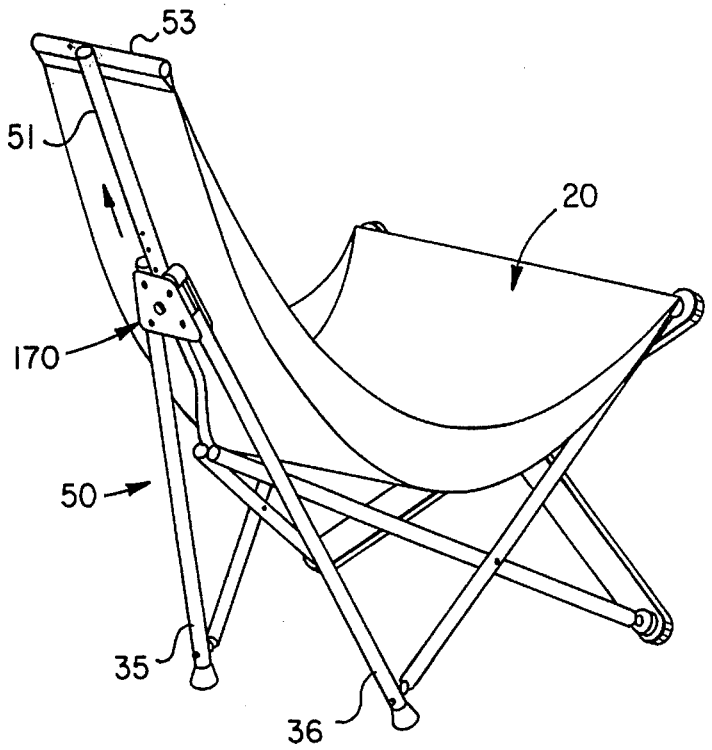
FIGS. 10 and 12 show alternate embodiments of the: chair back.
Figure 11A:
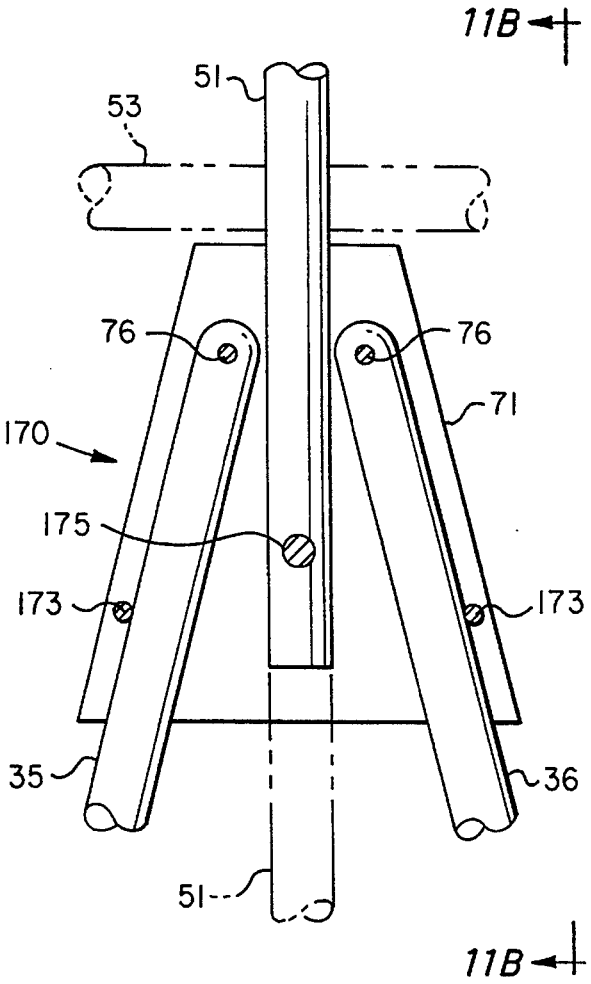
FIGS. 11A and 11B detail an alternate hinge means to the hinge means of FIG. 4 and employed in the chair back of FIG. 10.
Figure 11B:
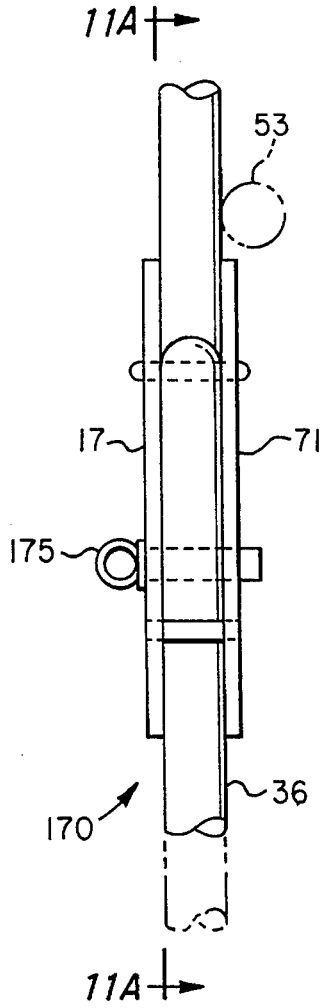

FIG. 10 depicts an alternate embodiment of chair 10 having a telescoping hinge means 170 coupling stile 51 to legs 35, 36. As detailed in FIGS. 11A and 11B, alternate hinge means 170 replaces spine 79 of FIGS. 5A, 5B with second gusset plate 171 which substantially matches gusset plate 71 in size and shape. Legs 35, 36 and stile 51 are sandwiched between plates 71, 171, and legs 35, 36 pivot about points 76 for folding chair 10. Stops 173 limit extension of legs 35, 36 when chair 10 is deployed for use. Clevis means 73 has been replaced with ring peg 175, Which cooperates with holes in gussets 71, 171 and in lower end 51B of stile 51, to hold stile 51 in its extended position for using chair 10. Ring peg 175 may be attached to hinge means 170 by a chain (not shown) to prevent losing it when not in use.

Multiple holes (not shown) may be provided in lower end 51B of stile 51, as optional positions for rail 53 supplementing or replacing holes 55 in upper end 51A of stile 51. As discussed above, however, it remains desirable that attachment point 57 allows rail 53 to pivot for folding chair 10, as shown in FIGS. 7B and 7C. Stile 51 slips vertically between legs 35, 36 to telescope downwardly for folding chair 10. Alternately, stile 51 may be removed and re-inserted between plates 71, 171, with rail 53 positioned between lower ends 35B, 36B of legs 35, 36, so that opposite ends of hammock seat 20 attach to opposite ends of chair 10 when it is folded for transporting, as in FIG. 1B.

Figure 12:
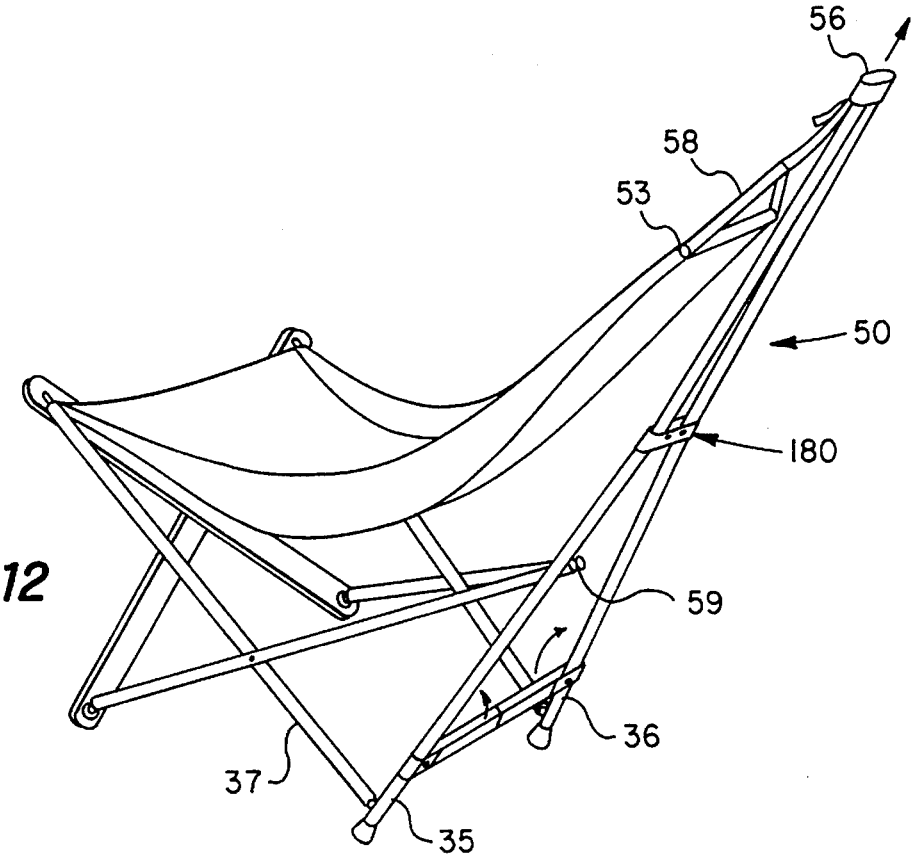

FIG. 12 depicts yet another alternate back means for chair 10 which replaces hinge means 70, 170 with friction coupler 180 detailed in FIGS. 13A–13C. In this embodiment, stile 51 is replaced with alternate stile means comprising two stile legs 183, 184 extending on either side of legs 35, 36 and converging to peak cap 56. Stile legs 183, 184 are held in frictional contact with legs 35, 36 by coupler 181 which compress stile legs 183, 184 against legs 35, 36 at bevels 185. Wedge 187 resists bending of legs 35, 36, creating a stable, tight coupling which easily can be taken apart by upward pressure on coupler 181. So taking apart back means 50 frees leg 35 to pivot about hinge 189 for folding chair 10. The cutaway section in FIG. 13A details screw 186 anchoring wedge 187 to leg 36. Another screw shown in phantom penetrating leg 35 may be provided in lieu of hinge 189, but such fixed attachment of leg 35 would prevent rotation of leg 35 for folding chair 10. One having ordinary skill in the art will recognize that alternate means of hinging leg 35 could be provided, including attachment by pinning it to a thin plate (not shown) in fashion similar to that shown in FIG. 11A, without departing from the spirit and scope of the present invention. Coupler 181 preferably is fabricated from aluminum, but could be of other metals, plastics or even wood. Wedge 187 preferably is made of wood, but also could be metal or plastic.

Figure 14:
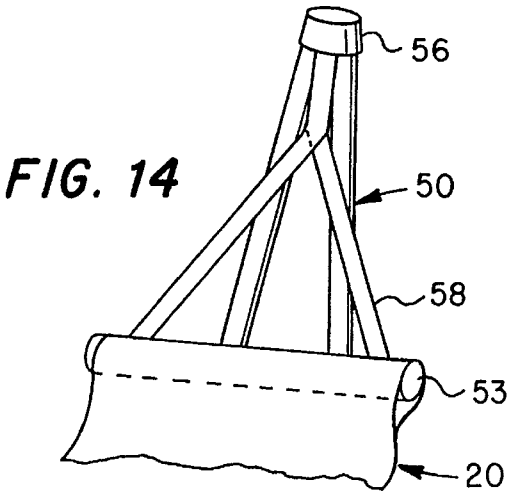
FIG. 14 details an alternate means of attaching the hammock to the chair back.

FIG. 12 also depicts, and FIG. 14 details, alternate means for attaching rail 53 to back means 50. Peak cap 56 surrounds stile legs 183, 184 at their apex, and yoke 58 suspends rail 53 therefrom. Suspended rails means shown in FIGS. 12 and 14 provides added advantages over the simpler rail means of pinning rail 53 to stile 51 (or to stile legs 183, 184, not shown). Yoke 58 may be fabricated partially or entirely from elastic materials, creating cushioning means for seat 20. When elastic, yoke 58 may serve further as alternate or supplemental cushioning means to tether means 60 and provides the cushioning advantages thereof discussed above. One having ordinary skill in the art will recognize that chair 10 just as well could be equipped with both yoke 58 and tether means 60.

As best depicted in FIG. 3B, the arrangement of coupling front X-structure and rear back means 50 through the V-structure and lateral braces 33, 34 creates a "lazy tongs" structure paralleling longitudinal axis A. As with other such lazy tongs structures more commonly seen in two dimensions (not shown), movement of the ends of component members thereof closer together extends the length of the structure, while moving them apart collapses the lazy tongs structure into a folded position. As seen in FIGS. 3A, 3B, 7A–7C, movement of front feet 31B, 32B toward one another causes vertical separation of front feet 31B, 32B from front seat corners 32A, 31A, respectively. Such separation movement, in turn, causes rear feet 35B, 36B to move toward front feet 32B, 31B, respectively, collapsing the lazy tongs structure of chair 10 as seen in FIG. "37B". Obviously, separating front feet 31B, 32B creates the opposite effect for deploying chair 10, limited by the width of seat 20.

In operation, user 1 unlocks brace 40 as described above and lifts seat 20 vertically approximately at its midpoint as depicted in FIG. 7B. He simultaneously grasps feet 31B, 32B to move them toward each other, collapsing the front X-structure and simultaneously the lazy tongs structure paralleling longitudinal axis A, until members 31, 32, lateral braces 33, 34, spindles 37, 38 and rear legs 35, 36 are substantially parallel and juxtaposed as depicted in FIG. 7C. User 1 depresses thumb bar 81 on the back side of plate 71 and pivots stile 51 downward between legs 35, 36 while rotating rail 53 to align it with stile 51. User 1 then secures stile 51 to one of front members 31 or 32 using elastic straps (not shown) or otherwise secures the resulting bundle together. Seat 20 may be used as a sling for convenient carrying of chair 10 (FIG. 1B). To deploy chair 10, the foregoing described steps are reversed.

FIG. 3B further shows the X-structure forwardly inclining from front feet 31B, 32B to front seat corners 31A, 32A. In contrast, back means 50 inclines rearwardly from rear feet 35B, 36B to rail 53. Such opposing inclines resolve loading forces from seat 20 into compressive loads and relieves the various components of frame 30 from significant moment loading. Loading from user 1 induced longitudinal rocking allowed by swivel connectors 90 is imparted to rear feet 35B, 36B through lateral braces 33, 34. The inclines also focus compressive forces toward an imaginary point located approximately as far below the surface upon which feet 31B, 32B, 35B, 36B bear as is located the load on seat 20 above that surface, the loading on chair 10 being located largely at the point of maximum sag of seat 20. This creates a relatively wide longitudinal base for supporting the load on chair 10 and lends it significant stability. Using seven eights (⅞") inch diameter hardwood dowels for stile 51 and legs 35, 36, three-quarter (¾") inch hardwood dowels for spindles 37, 38 and lateral braces 33, 34, and one by two (1"×2") hardwood boards for members 31, 32 imparts approximately five pounds total weight to chair 10, making it very light weight for carrying, even though it is very strong. In fact, a prototype chair 10 has been tested to withstand the combined weight of several adults sitting one atop the other in seat 20 at once. One having ordinary skill in the art will recognize that other suitable materials may be used for the rigid members of frame 30 to lighten chair 10 even more, and diameter sizes may vary according to strength requirements and aesthetics.

While the invention has been particularly shown and described with reference to a preferred embodiment, it will be understood by those skilled in the art that various changes in form and detail may be made therein without departing from the spirit and scope of the invention. For example, back means 50 could comprise a simple A-frame in lieu of the alternate embodiments discussed above and shown in FIGS. 2, 10 and 12. Such A-frame construction would most resemble FIG. 12, but hinge means 180 would be absent and legs 35, 36 would extend all the way to peak 56. Obviously, such construction would not collapse to as small a package as that depicted in FIG. 1B and 7C. Alternately, the legs of such an A-frame could telescope at their midpoints to shorten the A-frame for folding chair 10. Still another alternate configuration could employ individual pivot pins connecting stile legs 183, 184 to rear legs 35, 36, respectively, whereby they do not lie in the same plane (not shown). For folding, peak cap 56 could be removable, freeing ends 183A, 184A to swing on such pivot pins to a position juxtaposed rear feet 35B, 36B. Peak cap 56 could be then reinstalled to attach one end of hammock seat 20 to chair 10 for transportation thereof.

I claim:

1. A folding chair symmetric about a longitudinal axis and comprising a transverse X-structure formed by a pair of rigid members pivotally coupled together and having lower ends forming front feet and upper ends forming front seat corners of the chair;

transverse back means disposed rearward the X-structure and forming rear feet;

a transverse inclined V-structure having two rigid spindles coupled to the front feet, and converging rearwardly to form an apex at their rearward ends;

lateral braces on each side of the chair, each brace linking one of the rear feet to one of the front seat corners, the brace further being pivotally coupled to one of the spindles; and hammock means suspended between the back means and the front seat comers to form a seat.

2. The folding chair according to claim 1 and further comprising cushioning means coupled to the back means for cushioning the hammock means.

3. The folding chair according to claim 2 wherein the cushioning means comprises a resilient yoke coupled between the back means and the hammock means.

4. The folding chair according to claim 1 and further comprising tether means coupled between the back means and the apex of the transverse-structure.

5. The folding chair according to claim 1 further comprising a rail means coupled to the back means and wherein the rail means comprises a transverse bar received within a sheath in an upper end of the hammock means; and a pin pivotally coupling the bar at one of several alternative positions near the upper end of the back means.

6. The folding chair according to claim 1 wherein the back means comprises centrally disposed hinge means;

a pair of rear legs having upper ends coupled to the hinge means, the legs diverging downward to the rear feet; and stile means coupled to the hinge means and extending upward opposite the legs to couple to the rail means.

7. The folding chair according to claim 6 wherein the stile means further comprises a pair of stile legs spaced apart at the hinge means and converging upwardly to a peak.

8. The folding chair according to claim 7 wherein the hinge means comprises a spacer disposed between the rear legs and rigidly attached to at least one of the rear legs; and coupler means surrounding the upper ends of the rear legs adjacent the spacer and adapted to compressively couple the stile legs on opposite sides of the rear legs.

9. The folding chair according to claim 8 wherein the hinge means further comprises pivot means coupling one of the rear legs to the spacer for permitting said one of the rear legs to pivot transverse the longitudinal axis and relative to the other rear leg.

10. The folding chair according to claim 6 wherein the hinge means further comprises a first gusset plate pivotally coupled to each of the rear legs on the rearward side thereof;

a second gusset plate pivotally coupled to each of the rear legs forward thereof and opposite the first gusset plate; and pivot stop means for limiting extension the rear legs transverse the longitudinal axis.

11. The folding chair according to claim 10 and further comprising peg means penetrating through apertures in the first and second gusset plates between the rear legs, said peg means adapted to penetrate the stile means for pegging said stile means to a fixed position relative to the rear legs and the gusset plates.

12. The folding chair according to claim 6 wherein the hinge means further comprises a transverse gusset plate having an upper end and a lower end and being rigidly coupled to a first one of the rear legs;

pivot means coupling a second rear leg to the gusset plate for permitting the second leg to pivot coplanar with the first rear leg; and latch means for latching the stile to the gusset plate.

13. The folding chair according to claim 12 wherein the pivot means comprises a pivot pin coupling the leg to the lower end of the gusset plate;

a spacer post coupled to the upper end of the gusset plate;

a rigid spine extending between the pivot pin and the spacer post.

14. The folding chair according to claim 8 wherein the latch means comprises a clevis coupled between the lower end of the plate and a lower end of the stile; and clip means coupled to the upper end of the gusset plate and adapted to resiliently cooperate with a peg extending laterally from the stile and in vertical alignment with the clip means, for removably clipping the stile to the gusset plate.

15. The folding chair according to claim 14 wherein the clip means comprises a thumb lever extending normal the gusset plate and having a transverse aperture adapted to receive internally the peg;

a base rigidly coupled to the thumb lever and extending parallel the gusset plate opposite the thumb lever;

spring means for urging the thumb lever against the stile and for capturing the peg in the aperture.

16. The folding chair according to claim 11 wherein the spring means comprises a spring post extending normal the base and parallel the thumb lever through a hole in the gusset plate;

a spring affixed to the post opposite the base and bearing against the gusset plate.

17. The folding chair according to claim 1 wherein the hammock means comprises a substantially trapezoidal webbed sling disposed transverse the longitudinal axis, the sling having equivalent sides diverging between an upper base and a lower base;

a sheath formed in the upper base and including a rail means coupled to the back means, said sheath adapted to cooperate with the rail means; and a strap coupled between the lower base and the front seat corners.

18. The folding chair according to claim 17 wherein the hammock means further comprises two webbed panels, one panel coupled to each of the sides of the sling and extending substantially vertically to form sidewalls of the seat.

19. The folding chair according to claim 18 wherein each panel further comprises one arcuate edge mated with a side of the sling; and a substantially straight edge opposite the arcuate edge and having a length shorter than the side of the sling.

20. The folding chair according to claim 18 wherein the panels further comprise pocket means integral with the panels.

21. The folding chair according to claim 20 wherein the pocket means further comprise a second webbed panel co-extensive with the first panel and stitched along a perimeter thereof to form a pocket opening upwardly between the rail and the front seat corner.

22. A folding chair comprising two rigid front members having upper and lower ends and pivotally coupled to form a scissors structure transverse a longitudinal axis of the chair, their lower ends forming front feet and their upper ends forming front seat corners of the chair;

hinge means transverse the longitudinal axis rearward the scissors structure;

two rear legs depending downwardly from the hinge means to form rear feet;

stile means extending upwardly from the hinge means to form a back of the chair;

rail means coupled transverse the stile opposite the hinge means;

tether means coupled to the hinge means;

two spindles juxtaposed to form an apex coupled to the tether means, each spindle extending downwardly and forward from the apex and coupled to one of the front feet;

two lateral braces, each brace coupled between one of said rear feet and one of said front seat corners the brace further pivotally coupled to a spindle; and web seat means suspended between the rail means and the front seat corners.

23. The folding chair according to claim 22 wherein the rail means comprises a transverse bar received within a sheath in an upper end of the web seat; and a pin pivotally coupling the rail at one of several alternative positions near the upper end of the stile.

24. The folding chair according to claim 22 wherein the tether means comprises at least one resilient strap connected one end to the hinge means and the other end to the apex of the spindles.

25. The folding chair according to claim 22 wherein the web seat means comprises a webbed sling having a narrow upper end a wide lower end;

a sheath in the upper end adapted to cooperate with the rail means;

a strap coupled to the lower end and spanning between the front seat corners;

sidewalls coupled to opposite sides of the sling between the upper and lower ends, each sidewall having a first edge forming an arc and coupled to a side of the sling; and a second edge opposite the first edge and forming a chord of the arc between the rail means and the front corner; and pockets opening toward the second edge.

26. An folding chair comprising a pair of transverse, front members pivotally coupled to form a scissors structure, the members having lower ends forming front feet and upper ends forming front seat corners of the chair;

a collapsible extension brace between said members;

two spindles converging rearward from the front feet to an apex;

a transverse hinge coupled to the apex by a tether;

a pair of rear legs diverging from the hinge downwardly to form rear feet;

two lateral braces linking the rear feet to the front seat corners, the braces pivotally coupled to the spindles;

a stile coupled to the hinge and extending upwardly;

a transverse rail pivotally coupled at one of several alternative positions near the upper end of the stile; and a hammock seat suspended between the rail and the front seat corners and having a webbed sling having a narrow upper end a wide lower end;

a sheath in the upper end adapted to receive the rail;

a strap coupled to the lower end and spanning between the front seat corners; and sidewalls coupled to opposite sides of the sling between the upper and lower ends, each sidewall having a first edge forming an are and coupled to a side of the sling; and a second edge opposite the first edge and forming a chord of the arc between the rail and the front corner; and pocket means between the upper end and the lower end.

27. An improved method of quickly folding and deploying a folding chair, the chair having transverse, front members forming a scissors structure, the members having lower ends forming front feet and upper ends forming front seat corners of the chair, the scissors structure further having a collapsible extension brace between members; back means disposed rearward the front members and having a pair of rear legs diverging from hinge means downwardly to rear feet; stile means coupled to the hinge means and extending upwardly to transverse rail means; two spindles linking the front feet to an apex, the spindles pivotally coupled each to one of two lateral braces linking the rear feet to the front seat corners; and a hammock seat suspended between the rail and the front corners; the improved method comprising the steps of folding the chair by unlocking the extension brace to permit closing the scissors;

grasping the hammock seat between the rail and the front corners and pulling it upwardly; then moving the front feet together, thereby causing the rear feet to move toward each other and toward the front feet, until the front scissors members, the rear legs, the spindles and the lateral braces are substantially parallel and juxtaposed;

pivoting the stile means at the hinge means downwardly toward the rear feet to reposition the rail means between the rear legs; then securing the stile means to one of the front scissors members to hold the chair in folded position; then deploying the chair by unsecuring the stile means from the front scissors member; then pivoting the stile means and the rail means upwardly from between the rear legs into a position opposite the rear legs; then separating the front feet, thereby causing the rear feet to spread away from each other and away from the front feet; then locking the scissors extension brace to affix the scissors structure in extended position and straightening the hammock between the rail and the front corners.

* * * * *